US005366386A

United States Patent [19]

Liao

[11] Patent Number: 5,366,386

[45] Date of Patent: Nov. 22, 1994

[54] CONNECTING STRUCTURE OF A SERIES-PARALLEL LIGHTING STRING

[76] Inventor: Nan W. Liao, No. 18, Tzu Yu Road, Hsinchu,

[21] Appl. No.: 93,869

[22] Filed: Jul. 20, 1993

[51] Int. Cl.[5] ..... H01R 11/20

[52] U.S. Cl. ..... 439/419; 439/425

[58] Field of Search ..... 439/685, 409–413, 439/417, 419, 425, 426, 404, 405, 686, 695, 696, 701

[56] References Cited

U.S. PATENT DOCUMENTS 4,631,650 12/1986 Ahroni ..... 439/419

4,777,573 10/1988 Liao ..... 459/419

4,872,849 10/1989 Long ..... 439/685

*Primary Examiner*—David L. Pirlot

*Attorney, Agent, or Firm*—Morton J. Rosenberg; David I. Klein

[57] ABSTRACT

An improved connecting structure of a series-parallel lighting string comprises a base having provided on the connecting end thereof three semicircular grooves, in which the in-between one sits on a lower position than the others, to receive three lead wires arranged in a triangular array so that a conventional structure constituted of a base and a top cap that accommodate only two wires can be adapted for more wires, significantly widening the scope of its applications.

7 Claims, 13 Drawing Sheets

CONNECTING STRUCTURE OF A SERIES-PARALLEL LIGHTING STRING

BACKGROUND OF THE INVENTION

To facilitate the connection of a conducting copper strip with wires of a series-parallel lighting string, a conventional connecting structure makes use of sharpened tips of a copper strip piercing the outer insulation of lead wires to reach internal metal conductors. For example, the structures disclosed in U.S. Pat. Nos. 5,051,877 and 4,777,573 have a construction in which semicircular grooves are provided on the connecting end of a husk of the lampholder and the corresponding cap to form wireways to secure the cord. However, to increase the variations in the twinkles of a lighting string, sometimes, it has to use two, three, or even four sets of lead wires; then, such a prior art structure must have a larger connecting end as well as a proportionally enlarged cap with three, four, or more semicircular grooves provided thereon. Consequently, a prior art connecting structure will lead to an oversize and overweight lighting string due to increasing functions of a lighting string and is not cost-effective.

OBJECTS OF THE INVENTION

Therefore, it is the principal object of the invention to provide an improved connecting structure for a series-parallel lighting string, which is equipped with semicircular grooves of varied depths capable of receiving a cord composed of three lead wires arranged in a triangular array to broaden the applications of the connecting structure.

Another object of the invention is to provide an improved connecting structure in which a positioning flange situated on the inner wall of the base of a lampholder can secure a safety contact cap inside the base, enhancing safety effects, and one of the conducting strips can be fabricated integrally with the safety contact cap.

BRIEF DESCRIPTION OF THE DRAWINGS

The features and advantages of the invention will best be understood from the following detailed description of the varied preferred embodiments when read in conjunction with the accompanying drawings.

DETAILED DESCRIPTION

Figure 1:
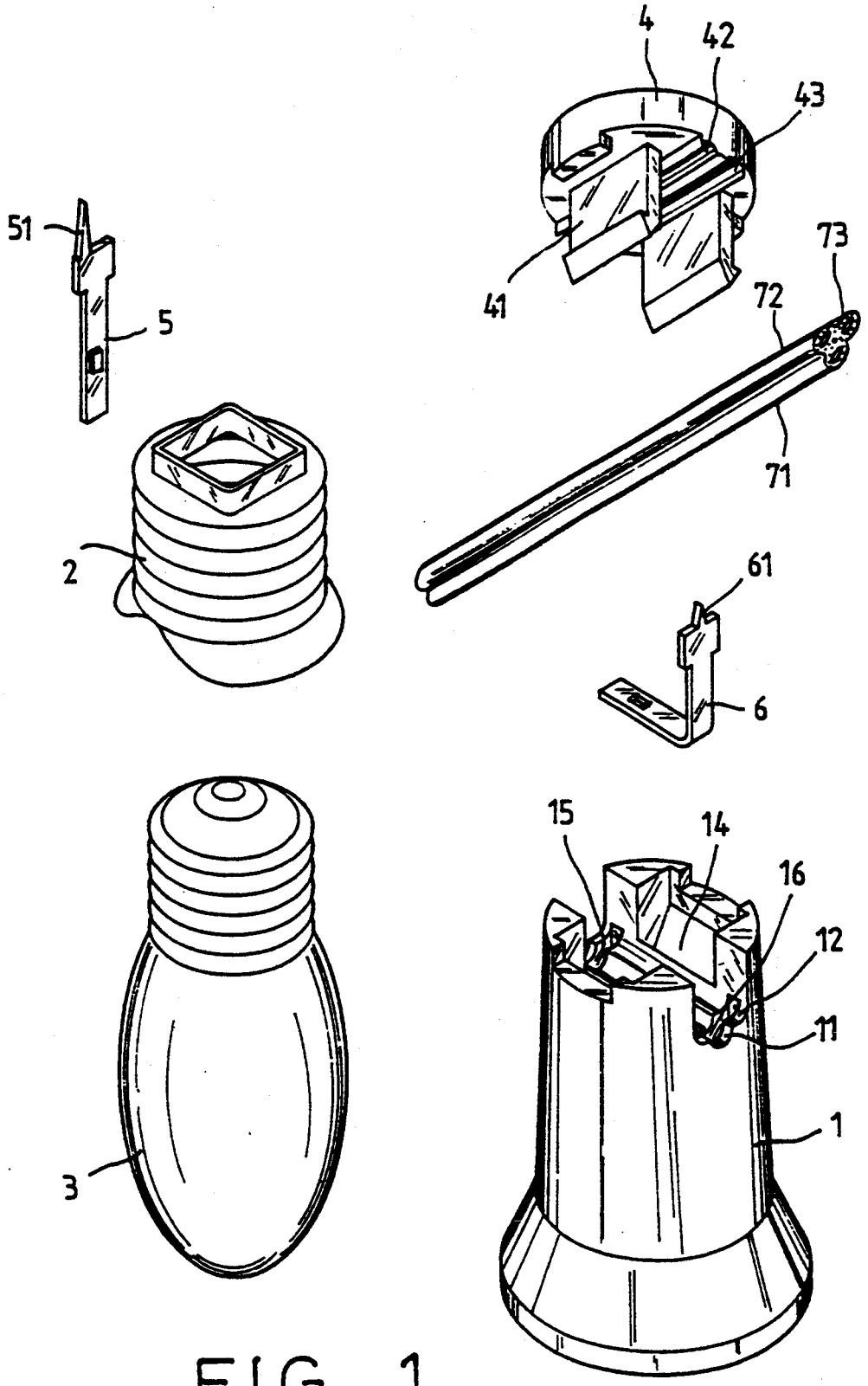
FIG. 1 is an exploded perspective view of an embodiment of a connecting structure of the invention.
Figure 2:
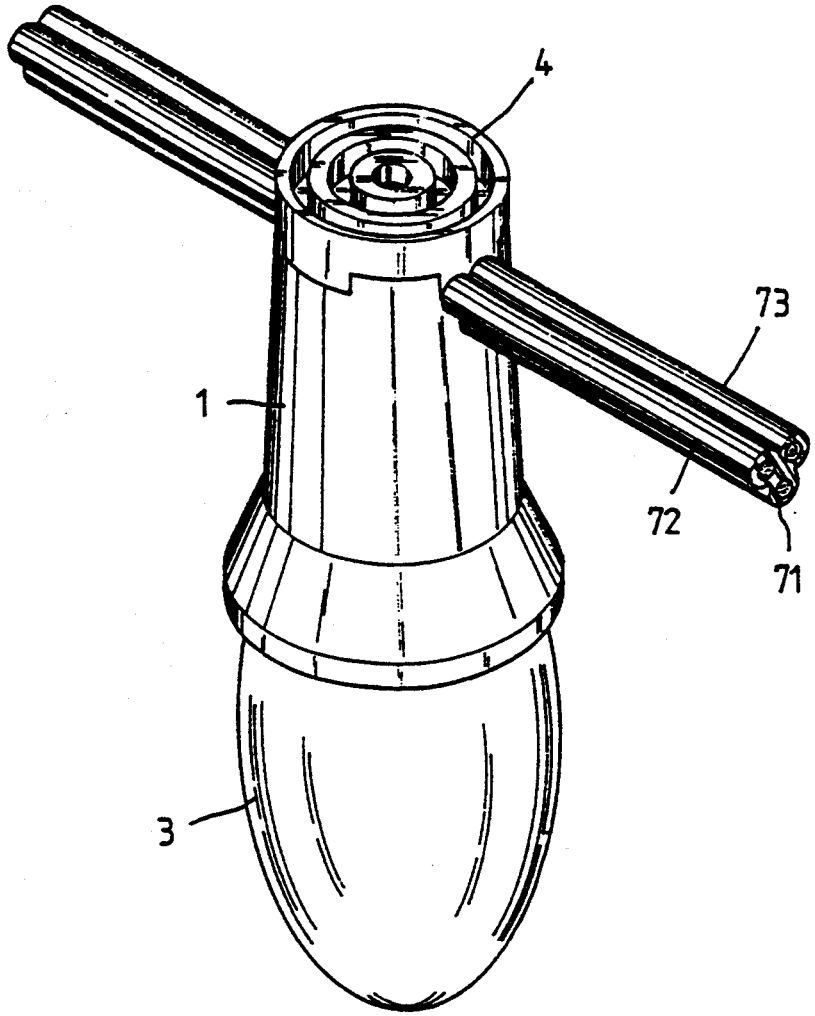
FIG. 2 is an external view of the embodiment of FIG. 1.
Figure 3:
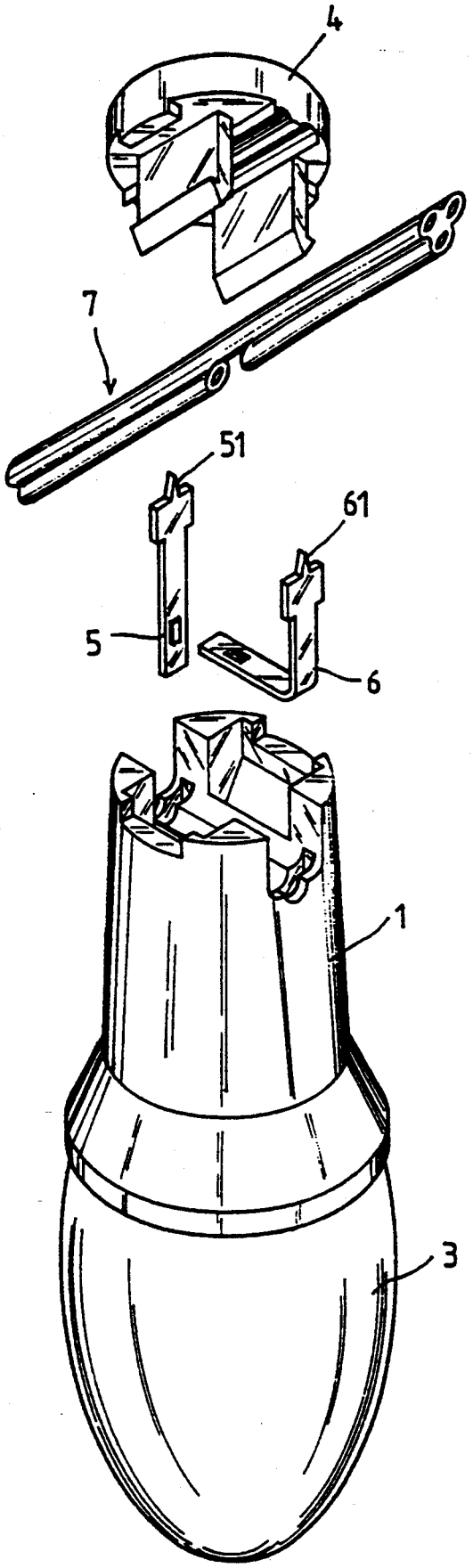
FIG. 3 is a perspective view showing an embodiment of the invention, in a partially assembled state.
Figure 4:
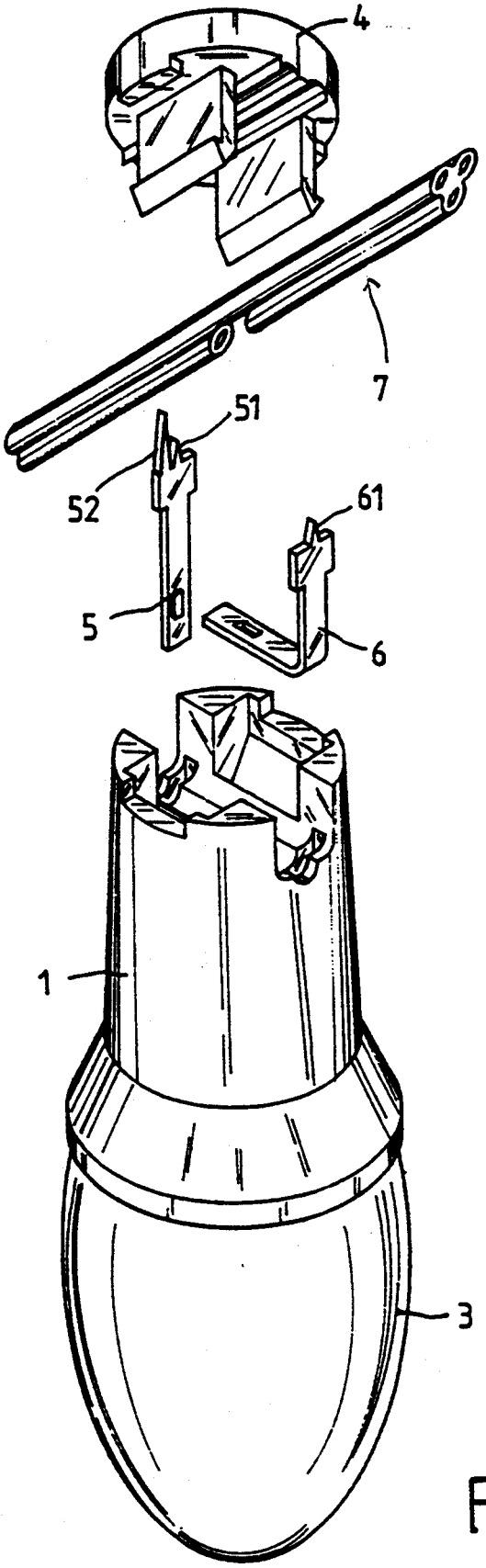
FIG. 4 is a perspective view of another embodiment of the invention, illustrating a modification made on the conducting copper strips.

With reference to FIG. 1, the improved connecting structure of the invention comprises a base (1), and a contact cap (2) installed inside the base (1). Further, a bulb (3) is mounted on the contact cap (2) and the base (1) has a top cap (4) engaged with the end thereof. The main features of the invention consist in the base (1) equipped with three semicircular grooves of which the in-between one has a depth larger than the others, and two conducting strips (5), (6) respectively piercing engaging holes (15), (16) individually arranged on the two ends of grooves. A power cord (7) composed of three conducting wires (71), (72), (73) routes through the top end of the base (1) and is firmly secured in the semicircular grooves by the top cap (4). The top cap (4) has tangs (41) and two semicircular recessed portions situated on the underside. By the tangs (41) being inserted into the locating holes (14) on the base (1), the top cap (4) can be mounted on the base (1) with the recessed portions (42), (43) lying on conducting wires (72), (73) and the wire (71) being squeezed into the in-between groove (11) as shown in FIG. 2. To accomplish an electrical connecting effect, change the relative positions of the sharpened tips (51), (52), (61) of two conducting strips (5), (6) to make these tips pierce through the insulation of wires. As a result, no other modification is needed as a two-wire connecting structure of the invention is adapted for three wires and the size can be minimized.

Figure 5:
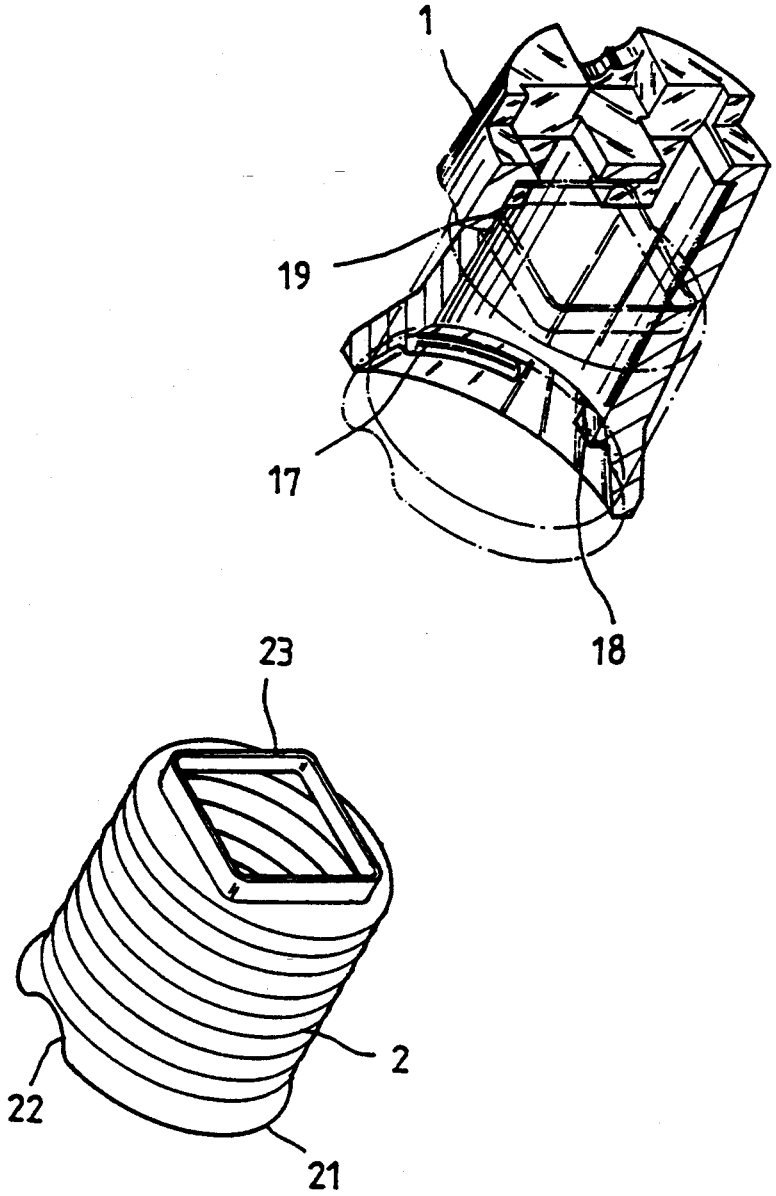
FIG. 5 is a schematic view showing the construction of the contact cap of the invention.
Figure 6:
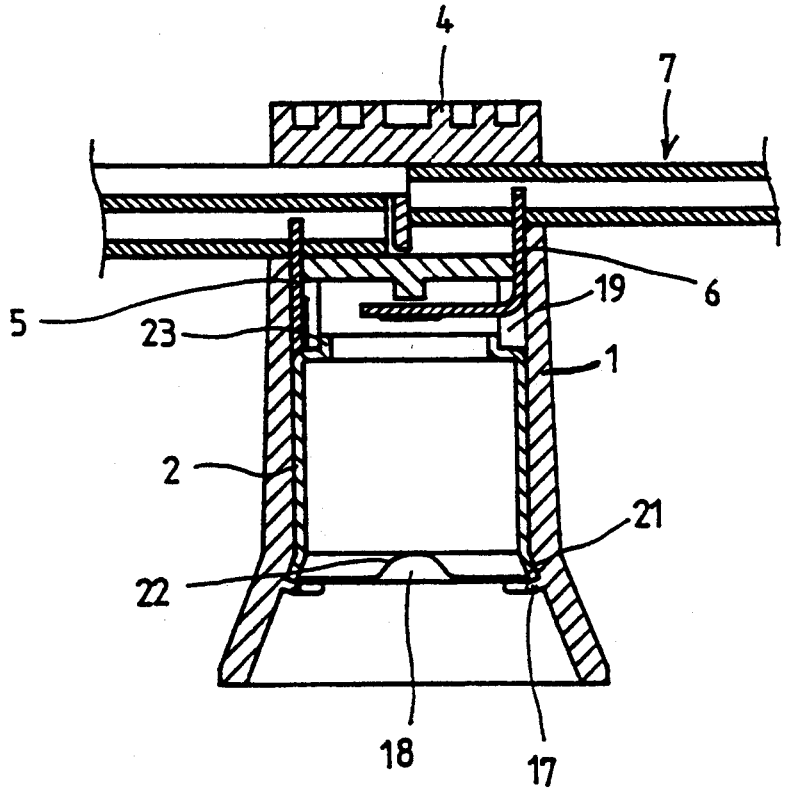
FIG. 6 is a cross sectional view of an embodiment of the invention.

As can be seen in FIGS. 5 and 6, to provide more protection for users, the invention adopts a safety contact cap (2) installed inside the base (1). The contact cap (2) is configured to have an obliquely outward bent portion (21) on the lower rim, and two flat portions (22) respectively disposed on opposing sides of the lower end. The contact cap (2) further has a square or round flange (23) on the top; however, the base (1) has a circular flange (17), a flat raised block (18), and a depression (19) formed thereon. When the contact cap (2) is inserted into the base (1), the flat portions (22) and the flange (23) of the contact cap respectively reach to the raised block (18) and the depression (19). Consequently, the contact cap (2) is restrained from rotating. After the contact cap (2) entirely enters the inside of the base (1), due to a little resilience existing in the bent portion (21) and the circular flange (17), the base will grip the contact cap to keep the latter from dropping.

Figure 7:
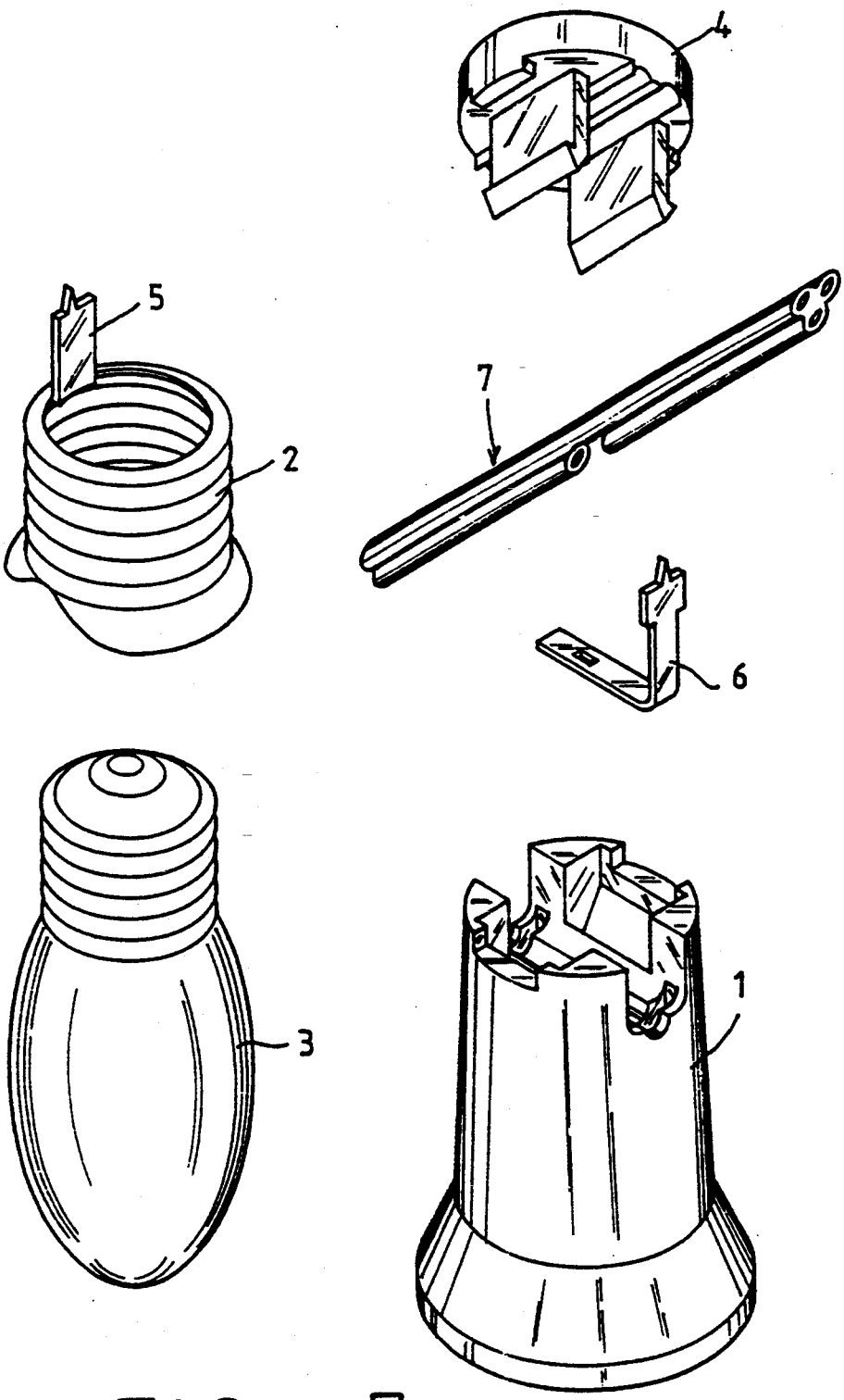
FIG. 7 is an exploded perspective view of another embodiment of the invention.
Figure 8:
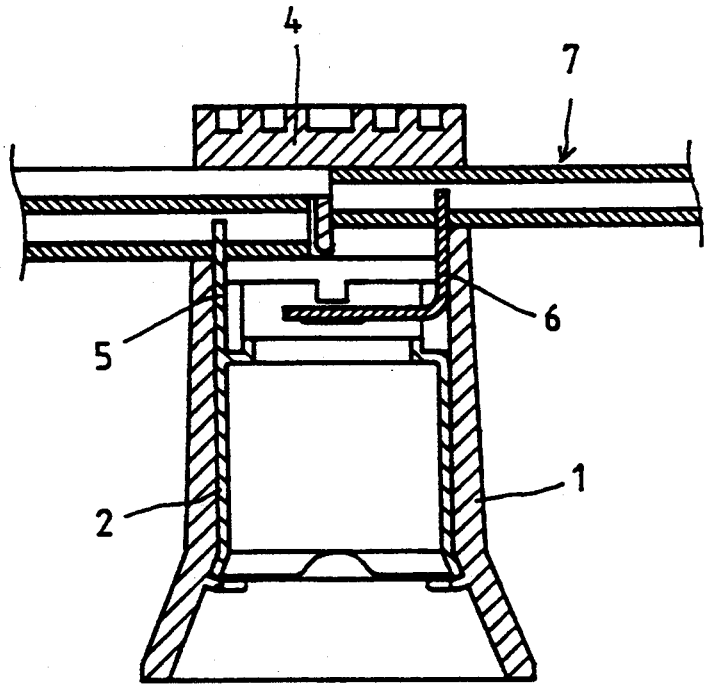
FIG. 8 is a cross sectional view showing an assembly of a connecting structure of FIG. 7.
Figure 9:
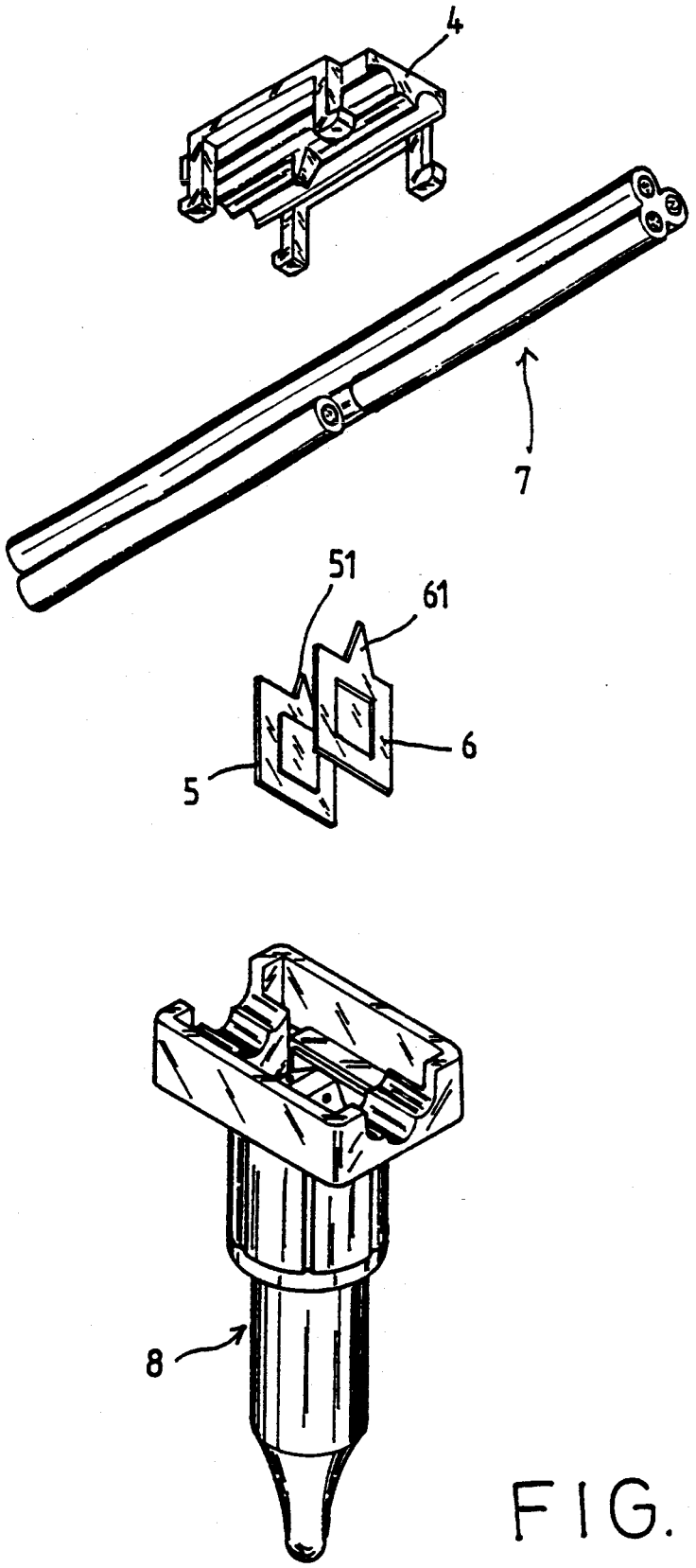
FIG. 9 is an exploded perspective view of still another embodiment of the invention.
Figure 10:
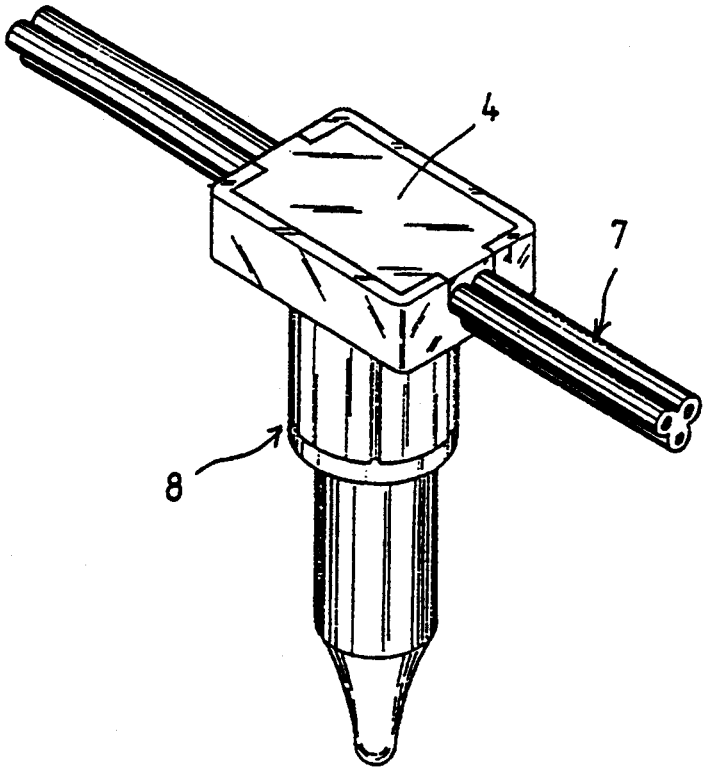
FIG. 10 is an external view of the embodied assembly of FIG. 9.
Figure 11:
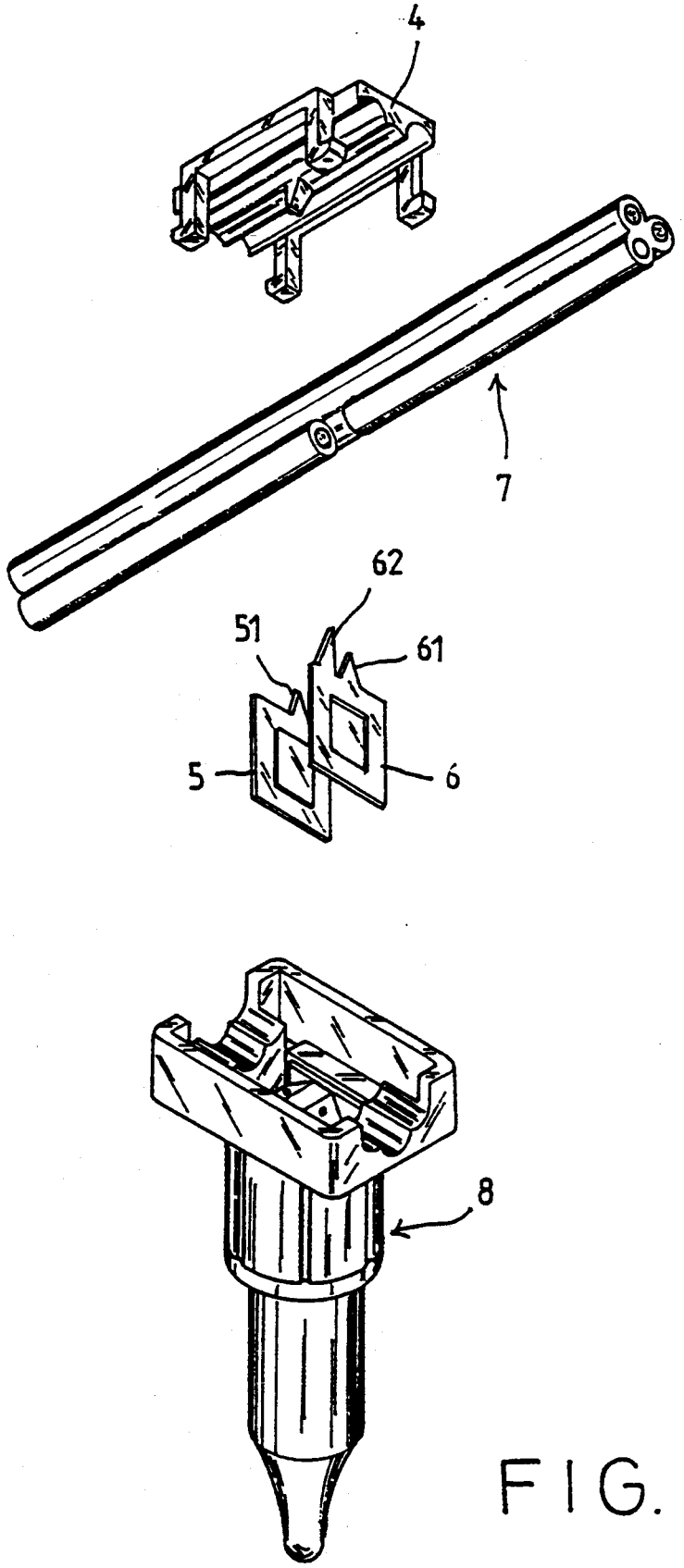
FIG. 11 is an exploded perspective view showing a connecting structure having another type of conducting strips.
Figure 12:
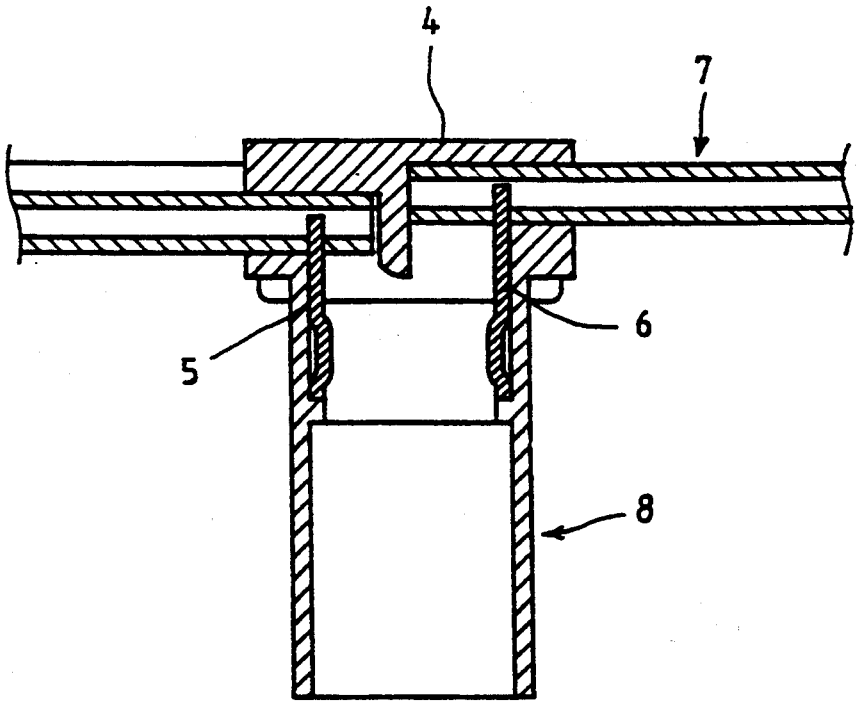
FIG. 12 is a cross sectional view of the embodied assembly of FIG. 9.
Figure 13:
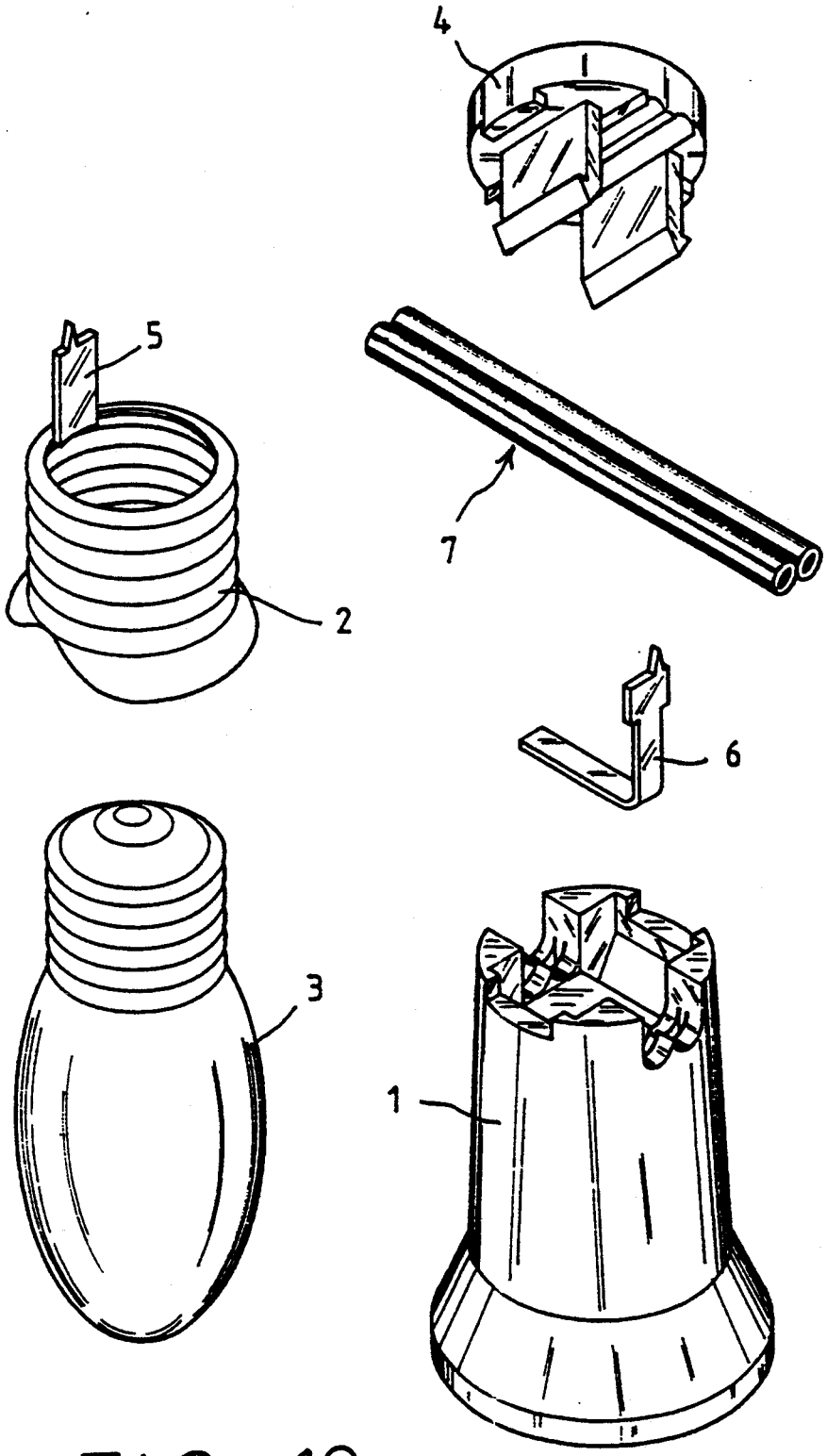
FIG. 13 shows still another embodiment of the invention.

Another preferred embodiment is shown in FIGS. 7 and 8, of which the conducting strip (5) is made integrally with the contact cap (2) to facilitate assembling. Besides, owing to the space-saving nature of the improved structure, the invention is applicable for miniature type lighting strings (8) as indicated in FIGS. 9 to 11, where the positions of sharpened tips (51), (61), (62) of the conducting strips (5), (6) have been changed to obtain an electrical connecting effect as illustrated in FIG. 12. FIG. 13 shows an application of a two-wire conducting structure of the invention, in which the components such as the base, the top cap, and so on are the same in size as those in FIG. 1.

In summary, the main object of the invention is to provide a connecting structure that can accommodate more wires in smaller space. Thus apparently other changes and modifications, such as a base capable of receiving four or five conducting wires, can be made in the structure of the invention without departing from the spirit of the invention and such variations are intended to be included within the scope of the following claims.

What is claimed is:

1. A connecting structure of a series-parallel lighting string comprising a base on the top of which is covered a top cap that secures conducting wires therein and inside which is associated therewith a safety contact cap on which a light bulb is mounted and being characterized in that said base has provided thereon three semicircular grooves in which the inbetween one has a depth larger than that of the others to receive a cord composed of three conducting wires in such a manner that two upper wires lie on the grooves arranged on two sides and the middle wire routes through the deepest central groove and all of them are secured thereon by the top cap.

2. A connecting structure of a series-parallel lighting string as claimed in claim 1, wherein the contact cap has an obliquely outward bent rim on a lower end, a generally square or round flange formed on a top, and flat portions disposed on two opposing sides; inside a base are formed a circular flange, a flat raised block, and a depression; as the contact cap and the base are assembled together, the mating between the corresponding portions of both parts keeps the contact cap from rotating and dropping.

3. A connecting structure of a series-parallel lighting string as claimed in claim 1, wherein the semicircular grooves formed on the base may be adapted to accommodate three or more conducting wires.

4. A connecting structure of a series-parallel lighting string as claimed in claim 1, wherein an unbent conducting strip can be made integrally with the contact cap to facilitate assembling.

5. A connecting structure of a series-parallel lighting string as claimed in claim 1, wherein an unbent conducting strip can be designed to be squeezed to reach a conducting wire without a touch with the other bent strip as the contact cap is placed into the inside of the base, producing an electrical connecting effect.

6. A connecting structure of a series-parallel lighting string as claimed in claim 1, wherein when an unbent conducting strip is fabricated integrally with the contact cap, such a combination can produce an effect of preventing the rotation of the contact cap and thus the flange formed on the top of the contact cap can be omitted.

7. A connecting structure of a series-parallel lighting string as claimed in claim 1, wherein the sharpened tips of an unbent conducting strip can be arranged in varied heights and positions so that they can pierce through the insulation of various conducting wires, accomplishing an electrical connecting effect.

* * * * *